United States Patent [19]

Yamazaki et al.

[11] Patent Number: 4,482,244

[45] Date of Patent: Nov. 13, 1984

[54] MAGNETIC BRUSH CLEANING DEVICE

[75] Inventors: Yoshio Yamazaki; Kiyoaki Kawamoto; Shun Kawata, all of Tokyo, Japan

[73] Assignee: Konishiroku Photo Industry Co., Ltd., Tokyo, Japan

[21] Appl. No.: 438,799

[22] Filed: Nov. 3, 1982

[30] Foreign Application Priority Data

Nov. 11, 1981 [JP] Japan ..... 56-179837
Nov. 11, 1981 [JP] Japan ..... 56-179838

[51] Int. Cl.³ ..... G03G 15/08

[52] U.S. Cl. ..... 355/15; 355/3 DD; 430/125; 118/652; 15/1.5 R

[58] Field of Search ..... 355/15, 3 DD, 14 D; 430/122, 125; 118/652; 15/256.51, 256.52, 1.5 R

[56] References Cited

U.S. PATENT DOCUMENTS 4,314,018 2/1982 Matsumoto et al. ..... 355/15 X

*Primary Examiner*—A. C. Prescott

*Attorney, Agent, or Firm*—James E. Nilles

[57] ABSTRACT

A magnetic brush cleaning device in which a magnetic attraction roller having a surface for attracting magnetic powder is disposed so as to face the surface of a toner image retaining member through a gap D, the height of a brushlike ear of the magnetic powder attracted to the magnetic attraction roller is restricted by ear restriction element faced to the surface of the magnetic attraction roller through a gap H and the brushlike ear of the magnetic powder thus restricted slides frictionally on the surface of the toner image retaining member so as to remove the toner on the surface of the image retaining member. The gap D and the gap H satisfy the following relation:

$$0.4\ \text{mm} \leqq H \leqq D \leqq H + 0.4\ \text{mm}.$$

The magnetic powder is an insulating carrier, the gap D is from 0.5 mm to 1.5 mm at the brushing position and a voltage of 800 V to 1,600 V of a polarity which electrically attracts the toner is applied to the surface of the magnetic attraction member. The surface of the magnetic attraction member has a flux density of at least 900 Gauss at the brushing position by magnets disposed at the rear thereof.

7 Claims, 3 Drawing Figures

MAGNETIC BRUSH CLEANING DEVICE

BACKGROUND OF THE INVENTION

1. Field of the Invention

This invention is concerned with an improvement in or relating to a magnetic brush cleaning device for use in an electrostatic reproducing apparatus or electrostatic recording apparatus using a powder toner. More specifically, the present invention relates to an improvement in a cleaning device of the type in which a magnetic attraction roller having a surface for attracting a magnetic powder is disposed so as to face the surface of a toner image retaining member, the height of a brush-like ear of the magnetic powder attracted to the magnetic attraction roller is restricted by ear restriction means and the brush-like ear of the magnetic powder frictionally slides on the surface of the toner image retaining member, thereby removing the toner on the toner image retaining member therefrom.

2. Description of the Prior Art

The magnetic brush cleaning device of the kind described above is disclosed in U.S. Pat. No. Re 28,566 (reissued Oct. 7, 1975), for example. In the magnetic brush cleaning device of this kind, a bias voltage of a polarity to attract electrically the toner on the toner image retaining surface is applied to the surface of a magnetic attraction roller so that the brush-like ear of the magnetic powder formed on the surface of the magnetic attraction roller, that is, the magnetic brush, collects the toner. The cleaning device does not call for an exhaust device or a filter required in the case of a fur brush cleaning device so that not only the cleaning device itself but also the reproducing apparatus or recording apparatus can be simplified in construction and be reduced in size and weight. Another advantage provided by the cleaning device is that contamination of the reproducing apparatus or recording apparatus by the scattering toner is considerably less and damage to the surface of the toner image retaining member which is often observed in a blade cleaning device is extremely unlikely. However, a cleaning device of this kind has a drawback in that the toner on the toner image retaining member can not be removed reliably from time to time or, the cleaning operation becomes sometimes unreliable.

In order to ensure the reliable cleaning operation, the magnetic brush must reliably isolate and collect the toner attaching to the toner image retaining member therefrom. To this end, the height of the magnetic brush and the relation of distance between the surface of the magnetic attraction roller and the surface of the toner image retaining member are of the utmost importance. The conventional magnetic brush cleaning devices mostly use an electrically conductive carrier having resistivity of $10^3$ Ohms to $10^{10}$ Ohms as the magnetic carrier. In this case, the following problems occur.

(1) Charge injection is likely to occur to the toner on the surface of the toner image retaining member from the surface of the magnetic attraction roller via the magnetic brush, and the toner to which the charge is thus injected can not be collected easily by the magnetic brush, so that setting of the bias voltage to be applied to the surface of the magnetic attraction roller becomes difficult.

(2) If fine pinholes or scratches exist on the surface of the toner image retaining member, the surface of the magnetic attraction member is short circuited to the toner image retaining member via the magnetic brush; hence, the effective bias voltage can not be applied to the surface of the magnetic attraction roller and the magnetic brush can not as a whole collect the toner.

(3) When the magnetic brush collects the toner and the mixing ratio of the magnetic carrier and the toner changes in the magnetic brush, the resistance of the magnetic brush changes so that the bias voltage on the surface of the magnetic attraction roller changes and toner collection by the magnetic brush can not be effected stably.

To cope with these problems, the following methods have been employed:

(1) A resin film or oxide film having high resistivity is disposed on the surface of the magnetic attraction roller so as to prevent discharge through the magnetic brush; and/or (2) A method which controls the bias voltage so that even when discharge through the magnetic brush occurs, the surface of the magnetic attraction roller holds an effective voltage.

However, the first method (1) creates a new problem in that the toner adheres to the resin film or oxide film on the surface of the magnetic attraction roller and the charge must be removed. The second method (2) makes the apparatus more complicated in construction and increases the cost of production.

The problems encountered in using the conductive carrier do not occur when an insulating carrier obtained by coating the magnetic carrier with an insulating resin is used as the carrier. In the case of the conductive carrier, however, the carrier itself that forms the magnetic brush plays the role of the opposed electrode that electrically attracts the toner on the toner image retaining member. The insulating carrier can not play such a role so that the magnetic attraction roller that forms the opposed electrode must be disposed closer to the surface of the toner image retaining member than the conductive carrier. Moreover, the bias voltage to be applied upon the surface of the magnetic attraction roller must be set to a higher level than in the case of the conductive carrier.

SUMMARY OF THE INVENTION

In view of the background described above, the present invention is directed to provide a magnetic brush cleaning device which insures the cleaning effect which is ideal when the insulating magnetic carrier is used and which is superior to the conventional cleaning effect when the conductive magnetic carrier is used. The present invention is characterized in that in a cleaning device of the type in which a magnetic attraction roller having a surface for attracting magnetic powder is disposed so as to face the surface of a toner image retaining member, the height of a brush-like ear of the magnetic powder attracted to the magnetic attraction roller is restricted by ear restriction means and the brush-like ear of the magnetic powder thus restricted slides frictionally across the surface of the toner image retaining member so as to remove the toner on the surface of the image retaining member, the gap D between the surface of the magnetic attraction roller and the surface of the toner image retaining member and the gap H between the surface of the magnetic attraction roller and the ear restriction means satisfy the following relation:

$0.4\ \text{mm} \leqq H \leqq D \leqq H + 0.4\ \text{mm}$

The present invention is further characterized in that in a cleaning device of the type in which a magnetic brush formed by attracting a magnetic carrier to the surface of a magnetic attraction member frictionally slides on the surface of a toner image retaining member so as to remove the toner on the surface of the image retaining member, the magnetic carrier is an insulating carrier, the most approximate distance between the surface of the magnetic attraction member and the surface of the toner image retaining member is from 0.5 mm to 1.5 mm at the frictional sliding position and a voltage of 800 V to 1,600 V of a polarity which electrically attracts the toner is applied to the surface of the magnetic attraction member.

Other objects, features and advantages of the invention will become clear from the following description of the preferred embodiments taken in conjunction with the accompanying drawings.

DESCRIPTION OF THE PREFERRED EMBODIMENTS

Figure 1:
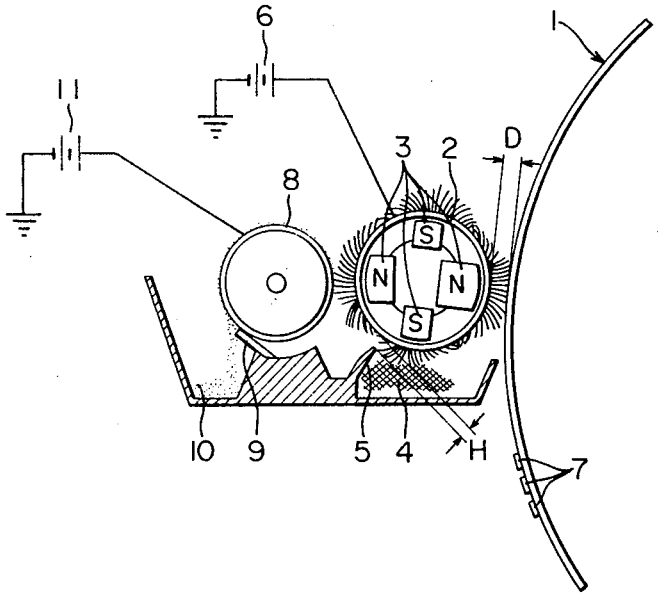
FIG. 1 is a schematic sectional view showing the cleaning device in accordance with one embodiment of the present invention.

In FIG. 1, reference numeral 1 represents a drum-like toner image retaining member having on its surface a photosensitive member, selenium for example, and which rotates clockwise. Reference numeral 2 represents a magnetic attraction roller made of an electrically conductive but not magnetic material such as aluminum. Magnets 3 are radially disposed and fixed inside the roller 2 in such fashion that one pole surface always faces the surface of the toner image retaining member 1 and all the pole surfaces oppose the inner surface of the magnetic attraction roller 2. The magnets 3 attract the magnetic carrier from a carrier stay 4 on the surface of the magnetic attraction roller 2 in the brush-like form, thereby forming a so-called "magnetic brush". When the magnetic attraction roller 2 rotates clockwise, the magnetic brush brushes across the surface of the toner image retaining member 1. Reference numeral 5 represents ear restriction means for restricting the height of the magnetic brush formed on the surface of the magnetic attraction roller 2. The ear restriction means keep the height of the magnetic brush at a predetermined level so that the brush can brush across the surface of the toner image retaining member 1 under the stable and predetermined condition.

Reference numeral 6 represents a bias power source for applying a voltage having such a polarity that electrically attracts the toner 7 on the surface of the toner image retaining member 1 onto the surface of the magnetic attraction roller 2. So long as this voltage is applied, the toner 7 is attracted to the surface of the magnetic attraction roller 2, is completely separated from the toner image retaining member 1 and is caught by the magnetic brush when the magnetic brush brushes across the surface of the toner image retaining member 1 so as to remove the toner 7 from its surface. When the magnetic attraction roller 2 rotates clockwise and the magnetic brush that has caught the toner reaches a position where it oppose a toner recovery drum 8, the toner caught by the magnetic brush is attracted by the voltage applied upon the surface of the toner recovery drum 8 and moves to the drum 8. Consequently, the toner is removed at this position from the magnetic brush on the magnetic attraction roller 2 and the brush becomes clean. The magnetic brush again brushes across the surface of the toner image retaining member 1 along with rotation of the magnetic attraction roller 2. The toner recovery drum 8 rotates counter-clockwise and a scraper 9 scrapes off the toner that has been recovered from the magnetic brush. The toner thus scraped is stored in a toner stay 10. The toner recovery drum 8 is made of the same material as that of the magnetic attraction roller 2. Reference numeral 11 represents a recovery bias power source for applying a bias voltage to the surface of the toner recovery drum 8 in order to attract the toner.

In order to always ensure the reliable and stable cleaning operation described above, it is necessary that the relation $0.4\ \text{mm} \leqq H \leqq D \leqq H + 0.4\ \text{mm}$ be satisfied for the gap H between the ear restriction means 5 and the surface of the magnetic attraction roller 2 shown in the drawing and for the gap D between the surface of the magnetic attraction roller 2 and the surface of the toner image retaining member 1.

Figure 2:
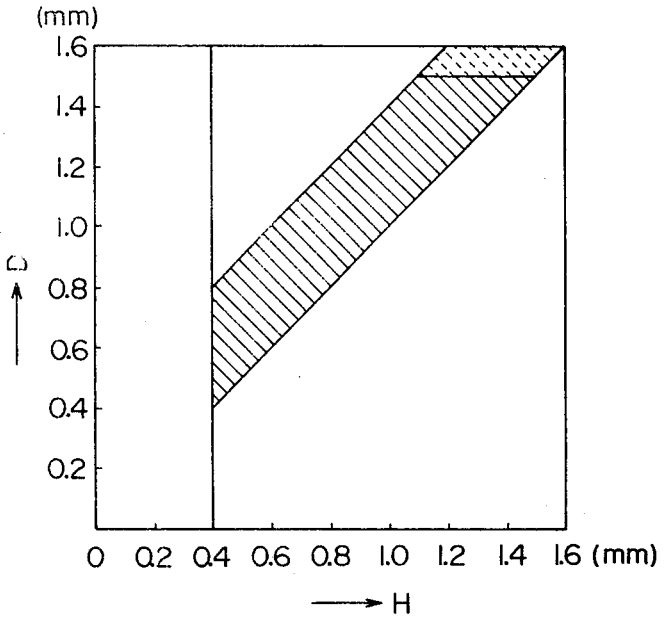
FIG. 2 is a diagram showing the relation of the gaps between the toner image retaining surface and the surface of the magnetic attraction roller and between the surface of the magnetic attraction roller and the ear restriction means, which gaps provide a stable and reliable cleaning effect.

The portion indicated by oblique lines in FIG. 2 represents the range that satisfies the relation described above. Among the range, the portion indicated by the solid oblique lines below $D = 1.5$ mm represents the range in which the cleaning operation is reliably carried out by use of an insulating magnetic carrier. In other words, within a range A, in which the gap H between the ear restriction means 5 and the surface of the magnetic attraction roller 2 is smaller than 0.4 mm, the height of the magnetic brush formed on the surface of the magnetic attraction roller 2 is not uniform and the brush can not brush across the surface of the toner image retaining member 1 in a reliable manner.

Even if the gap H is at least 0.4 mm, a problem would occur within a range B in which the gap D between the surface of the magnetic attraction roller 2 and the surface of the toner image retaining member 1 is smaller than the gap H. The magnetic carrier of the magnetic brush is packed at the portion of the gap D, scattering of the magnetic carrier increases greatly and a part of the carrier attaches to the surface of the toner image retaining member 1. This would result in adverse influences upon the subsequent toner development or transfer and the surface of the toner image retaining member 1 is likely to undergo frictional damage. Within a range C in which the gap H is at least 0.4 mm and the gap D is greater than (H+0.4 mm), the force of friction on the surface of the toner image retaining member 1 by the magnetic brush becomes weaker so that the cleaning operation is defective. The abovementioned phenomenon holds true not only in the case in which the magnetic carrier forming the magnetic brush is conductive but also in the case in which the magnetic carrier is non-conductive. If the magnetic carrier is of the insulating type, the toner 7 is not caught by the magnetic brush and cleaning defect occurs within a range indicated by dotted oblique lines where the gap D is greater than 1.5 mm, even though the gaps H and D satisfy the relation 0.4 mm $\leqq H \leqq D \leqq H+0.4$ mm and the magnetic brush isolates the toner 7 on the surface of the toner image retaining member 1, because the surface of the magnetic attraction roller 2, to which the bias voltage is applied, is far. After all, when the conductive magnetic carrier is used, reliable and consistent cleaning operation is effected within the ranges indicated by the solid oblique lines and the dotted oblique lines and when the insulating magnetic carrier is used, it is effected within the range of the solid oblique lines which is narrower than the range obtained by use of the conductive magnetic carrier. It is preferred to use the insulating carrier, however, because the problem described above occurs when the conductive carrier is used.

A preferred insulating magnetic carrier consists of magnetic powder such as magnetic iron powder whose surface is coated to a thickness of about 1 μm with an insulating resin, and has a particle size in the order of several dozens of microns to a hundred microns. Needless to say, the magnetic powder is not limited to iron powder, in particular. The resin for coating the magnetic powder preferably consists of a styrene-methyl methacrylate copolymer having a polymerization ratio of 3:7 but this copolymer is merely illustrative, the resin not being limited to this copolymer. Copolymers between a styrene compound and an acrylic acid ester or a methacrylic acid ester are extremely preferable as the insulating coating resin because they have good coating properties. Typical substituted styrene compounds are α-methylstyrene, vinyl-toluene, 4-bromostyrene, 4-chloro-5-fluorostyrene, 2-chlorostyrene, 2,5-dichlorostyrene, 2,5-difluorostyrene, 2,4-dimethylstyrene, 4-ethoxystyrene, 4-ethylstyrene, 4-hexyldecylstyrene, 3-oxymethylstyrene, 4-iodo-styrene, 4-isopentoxystyrene, 4-nonadecylstyrene and their mixtures. Typical substituted and unsubstituted acrylic- and methacrylic acid esters are methyl acrylate, ethyl acrylate, tert-butyl acrylate, neopentyl acrylate, methyl α-chloroacrylate, isobutyl acrylate, cyclohexyl acrylate, dodecyl acrylate, hexyldecyl acrylate, isopropyl acrylate, tetradecyl acrylate, ethylene glycol dimethacrylate, secbutyl acrylate, 2-n-tert-butylaminoethyl methacrylate, 2-butyl methacrylate, glycidyl methacrylate, 2-chloroethyl methacrylate, 3,3-dimethylbutyl methacrylate, 2-ethylhexyl methacrylate, 2-methoxyethyl methacrylate, pentyl methacrylate, methyl methacrylate, ethyl methacrylate, n-butyl methacrylate, isobutyl methacrylate, isopropyl methacrylate, propyl methacrylate, 2-ethylhexyl acrylate and their mixtures.

The coating layer may contain other compounds, when necessary. The typical examples of such compounds are resins or charge controllers. Definite examples include epoxy resin, polyamide resin, polyester resin, petroleum type resin, acetal resin, vinyl chloride, vinyl acetate, halogenated resins of their copolymers, butadiene type polymer resin. Examples of the charge controllers include oil black, lampblack, Nigrosine dyes, Aniline Blue, Chalcoyl Blue, Chrome Yellow, Ultramarine Blue, Methylene Blue Chloride, Phthalocyanine Blue, Rose Bengal and other pigments or dyes.

When the insulating magnetic carrier described above is used, it is preferred to set the bias voltage to be applied upon the surface of the magnetic attraction roller 2 by the bias power source 6 within the range of 800 to 1,600 V. If the bias voltage is below 800 V, the magnetic brush can not easily collect the isolated toner 7 even if the gap D of the magnetic attraction roller 2 is reduced to the minimum allowable gap. On the other hand, if it is above 1,600 V, the toner caught by the magnetic brush can not be easily recovered by the toner recovery drum 8 so that the cleaning capacity of the magnetic brush would drop and the magnetic carrier of the magnetic brush would attach to the surface of the toner image retaining member 1 due to the electric force. Thus, the cleaning operation can not be carried out consistently and reliably.

In order to form a film magnetic brush and to ensure sufficient isolation of the toner 7 on the surface of the toner image retaining member 1 not only when the insulating magnetic carrier is used, it is preferred that the flux density by the magnets 3 on the surface of the magnetic attraction sleeve 2 be at least 900 Gauss and more preferably, at least 1,000 Gauss, at the position where the magnetic brush brushes across the surface of the toner image retaining member 1. It is further preferred that the magnetic attraction roller 2 be rotated at a surface speed faster of two to three times the surface speed of the toner image retaining member 1. To reliably recover the toner that has been caught by the magnetic brush, the surface voltage of the toner recovery drum 8 given by the recovery bias power source 11 is preferably sufficiently greater than the voltage of the magnetic attraction roller 2 given by the bias power source 6. The voltage to be applied to the magnetic attraction roller 2 and the voltage to be applied to the toner recovery drum 8 are naturally voltages of such a polarity that electrically attracts the toner, respectively.

Another embodiment of the present invention uses an insulating magnetic carrier consisting of magnetic powder coated with an about 1 μm thick coating layer of the type described above. The voltage applied by the bias voltage 6 to the magnetic attraction roller 2 ranges from 800 to 1,600 V and the surface gap G between the magnetic attraction roller 2 and the toner image retaining member 1 is from 0.5 mm to 1.5 mm.

Figure 3:
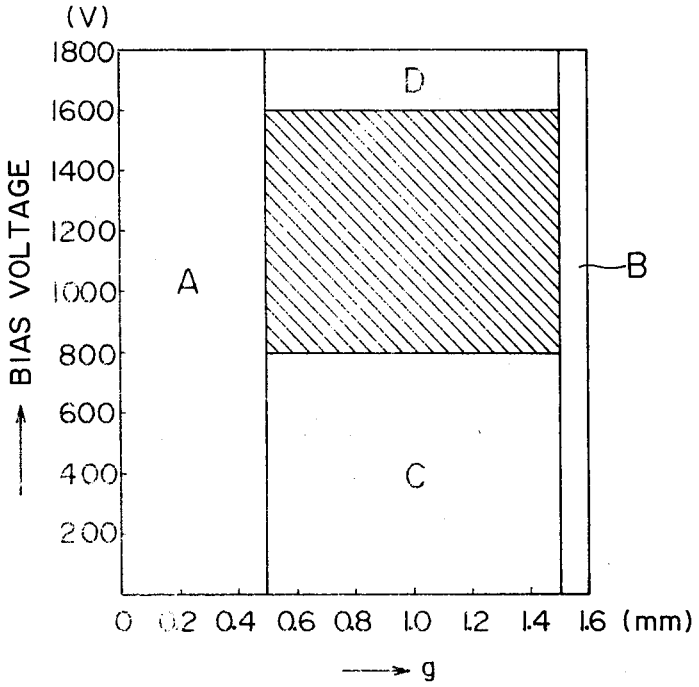
FIG. 3 is a diagram showing the relation between the voltage to be applied to the magnetic attraction surface and the effective range of the most approximate distance from the magnetic attraction surface at the position where the magnetic brush brushes across the surface of the toner image retaining member and the surface of the toner image retaining member.

The range indicated by the oblique lines in FIG. 3 represents the range described above. Within a range A in which the gap G is smaller than 0.5 mm, the magnetic brush formed on the magnetic attraction roller 2 is likely to be distributed and to become non-uniform when it brushes across the surface of the toner image retaining member 1; hence, the cleaning operation can not be effected consistently. Within a range B in which the gap G is greater than 1.5 mm. The frictional force by the magnetic brush on the surface of the toner image retaining member 1 becomes weak so that isolation of the toner 7 does not easily occur. Within a range C in which the voltage of the magnetic attraction sleeve 2 is below 800 V even if the gap G is from 0.5 to 1.5 mm, the magnetic brush can not easily catch the toner 7 even though it can isolate the toner. Within a range D in which the voltage of the magnetic attraction roller 2 is above 1,600 V, on the other hand, the toner recovery drum 8 can not recover the toner that has been collected by the magnetic brush so that the cleaning capacity of the magnetic brush would drop or the toner would adhere to the surface of the toner image retaining member 1 because of the electric force. Cleaning the surface of the toner image retaining member 1 is carried out consistently and reliably within the range indicated by the oblique lines.

As described in the foregoing, the magnetic brush cleaning device in accordance with the present invention ensures consistent and reliable cleaning. Especially when the magnetic carrier is of the insulating type, the device, unlike the conductive carrier, does not inject the charge to the toner on the surface of the toner image retaining member. Even if fine pinholes or scratches develop on the surface of the toner image retaining member, bridging does not occur between the surface of the magnetic attraction roller and the toner image retaining member. Even when the toner concentration of the magnetic brush changes due to cleaning, the bias voltage does not change so that no special devices or operations are required to maintain the bias voltage at a constant level. Since it is not necessary to deposit an insulating resin coating or an oxide film on the surfaces of the magnetic attraction roller and toner recovery drum, the life of the toner image retaining member can be extended. Thus, a cleaning device which is simpler, smaller and lighter can be produced at a lower cost.

The present invention can also be applied to magnetic attraction surfaces and the toner image retaining surfaces which are not only of the cylindrical type but also of the flat-like or conveyor belt type.

What is claimed is:

1. A magnetic brush cleaning device for removing toner remaining on the surface of an image retaining member of electrostatic reproducing apparatus or the like, comprising: a magnetic attraction means having an electrically conductive roller and a magnet provided in said roller, disposed so as to face said surface of said image retaining member, a magnetic and insulating carrier attracted on the surface of said roller by magnetic force, restriction means adjacent said magnetic attraction means to restrict the height of a brushlike ear of said magnetic and insulating carrier attracted to said magnetic attraction means, said brushlike ear of said magnetic and insulating carrier thus restricted being slidable frictionally on said surface of said image retaining member so as to remove said toner on said surface of said image retaining member, wherein a gap D between said surface of said roller and said surface of said image retaining member, and a gap H between said surface of said roller and said restriction means satisfy the following relation:

$$0.4\ \text{mm} \leqq H \leqq D \leqq H + 0.4\ \text{mm}.$$

2. A magnetic brush cleaning device according to claim 1, wherein said magnetic powder is a magnetic carrier.

3. A magnetic brush cleaning device according to claim 1, wherein said magnetic powder is a magnetic toner.

4. A magnetic brush cleaning device according to claim 2, wherein the most approximate distance of said gap D between said surface of said magnetic attraction means and said surface of said image retaining member is from 0.5 mm to 1.5 mm at said brushing position and further comprising an electric power source for applying a voltage of 800 V to 1,600 V of a polarity which electrically attracts said toner to said surface of said magnetic attraction means.

5. A magnetic brush cleaning device for removing toner remaining on the surface of an image retaining member comprising: a magnetic attraction means including a magnet and having a surface spaced from and movable relative to said surface of said image retaining member, a source of supply of magnetic carrier adjacent said magnetic attraction means whereby a magnetic brush formed by attracting said carrier to said surface of said magnetic attraction means brushes across said surface of said image retaining member so as to remove the toner remaining on said surface of said image retaining member, the improvement wherein said magnetic carrier is an insulating carrier, the most approximate distance between said surface of said magnetic attraction means and said surface of said image retaining member being from 0.5 mm to 1.5 mm at a brushing position, and an electric power source for applying a voltage of 800 V to 1,600 V of a polarity which electrically attracts said toner to said surface of said magnetic attraction means.

6. The magnetic brush cleaning device as defined in claim 5, wherein said surface of said magnetic attraction means has a flux density of at least 900 Gauss at said brushing position by magnets disposed at the rear thereof.

7. A magnetic brush cleaning device according to claim 5 or 6, wherein said magnetic attraction means comprises a roller having a surface for attracting magnetic powder is disposed so as to face the surface of said image retaining member, the height of a brushlike ear of the magnetic powder attracted to said surface of said magnetic attraction roller is restricted by ear restriction means, the brushlike ear of said magnetic powder thus restricted slides frictionally on said surface of said image retaining member so as to remove the toner on said surface of said image retaining member, and a gap D between said surface of said magnetic attraction roller and said surface of said image retaining member and a gap H between said surface of said magnetic attraction roller and said ear restriction means satisfy the following relation:

$$0.4\ \text{mm} \leqq H \leqq D \leqq H + 0.4\ \text{mm}.$$

* * * * *